US008540246B1

(12) United States Patent
Qualey

(10) Patent No.: US 8,540,246 B1
(45) Date of Patent: Sep. 24, 2013

(54) BALANCED SIX-SIDED DICE

(71) Applicant: Jeffery S. Qualey, Odenton, MD (US)

(72) Inventor: Jeffery S. Qualey, Odenton, MD (US)

( * ) Notice: Subject to any disclaimer, the term of this patent is extended or adjusted under 35 U.S.C. 154(b) by 0 days.

(21) Appl. No.: 13/718,394

(22) Filed: Dec. 18, 2012

(51) Int. Cl.
*A63F 9/04* (2006.01)

(52) U.S. Cl.
USPC ..... 273/146; D21/372; D21/373

(58) Field of Classification Search
USPC ..... 273/146; D21/372, 373
See application file for complete search history.

(56) References Cited

U.S. PATENT DOCUMENTS 1,223,365 A 4/1917 Breitung
1,279,409 A 9/1918 Murray
2,560,187 A * 7/1951 Post ..... 273/146
3,399,897 A 9/1968 Mitchell
D267,961 S * 2/1983 Bjon ..... D21/373
4,465,279 A 8/1984 Larson

OTHER PUBLICATIONS

Ivars Peterson, "Unfair Dice" Ivars Peterson's Math Trek; Oct. 26, 1998. http://www.maa.org/mathland/mathtrek_10_26_98.html.
Ed Pegg Jr. "Math Games" Mathematical Association of America; May 16, 2005. http://www.maa.orgleditorial/mathgames/mathgames_05_16_05.html.

* cited by examiner

*Primary Examiner* — Benjamin Layno
(74) *Attorney, Agent, or Firm* — McClure, Qualey & Rodack, LLP

(57) ABSTRACT

Balanced six-sided dice are provided. In this regard, a representative die includes a cubical body provided with a corresponding set of seven indicia on each face, wherein six of the seven indicia of each set form a hexagon pattern with a seventh of the indicia being positioned at a center of the corresponding face.

7 Claims, 3 Drawing Sheets

BALANCED SIX-SIDED DICE

BACKGROUND

1. Technical Field

The present disclosure relates generally to dice and, more particularly, six-sided dice.

2. Description of the Prior Art

Multiple sided dice have been described in the prior art. By way of example, U.S. Pat. No. 1,223,365 (dated Apr. 24, 1917) to Breitung, U.S. Pat. No. 1,279,409 (dated Sep. 17, 1918) to Murray, U.S. Pat. No. 3,399,897 (dated Sep. 3, 1968) to Mitchell, U.S. Pat. No. 4,465,279 (dated Aug. 14, 1984) to Larson disclosed dice of various configurations. However, none of the dice previously presented provide both a physical balance and a face-symmetrical balance in a six-sided die.

SUMMARY

Balanced six-sided dice are provided. In this regard, an example embodiment of a die comprises a cubical body provided with a corresponding set of seven indicia on each face, wherein six of the seven indicia of each set form a hexagon pattern with a seventh of the indicia being positioned at a center of the corresponding face.

Other devices, systems, methods, features, and/or advantages of the present disclosure will be or may become apparent to one with skill in the art upon examination of the following drawings and detailed description. It is intended that all such additional devices, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Six-sided cubic dice are provided. In an example embodiment, on each face of the die, six indicia are placed at the vertices of a regular hexagon, and one at the center. On adjacent faces, the hexagon patterns are oriented such that each is rotated with respect to the other. In some embodiments, a first hexagon pattern is oriented so that one of the vertices of the pattern is positioned closest to an edge of the die. For the second hexagon pattern of the face that shares the edge, two vertices of the second hexagon pattern are positioned close to the edge. This results in the line segment that interconnects the two vertices being substantially parallel to the edge. In this manner, a physically balanced die may be provided. Notably, this configuration represents an improvement over the physical balance of the six-sided die presented by Murray (U.S. Pat. No. 1,279,409 dated Sep. 17, 1918).

In some embodiments, all indicia are marked with pigment (e.g., paint), or otherwise, with either similar or contrasting color to maintain the physical balance. The contrasting colored "pips" represent the countable indicia from one to six. As with a standard six-sided die, the addition of the countable pips on one face, and its opposite face, equals seven. Six is opposite one, five is opposite two, and four is opposite three.

All countable pips on each face are vertically and horizontally symmetrical, meaning that the horizontal halves of each face are mirror images of each other and the vertical halves of each face are mirror images of each other. Furthermore, the opposite faces are complements, whereby together, the countable pips occupy all seven indicia. Again, this is an improvement over the non-symmetrical six-sided die presented by Murray.

Figure 1:
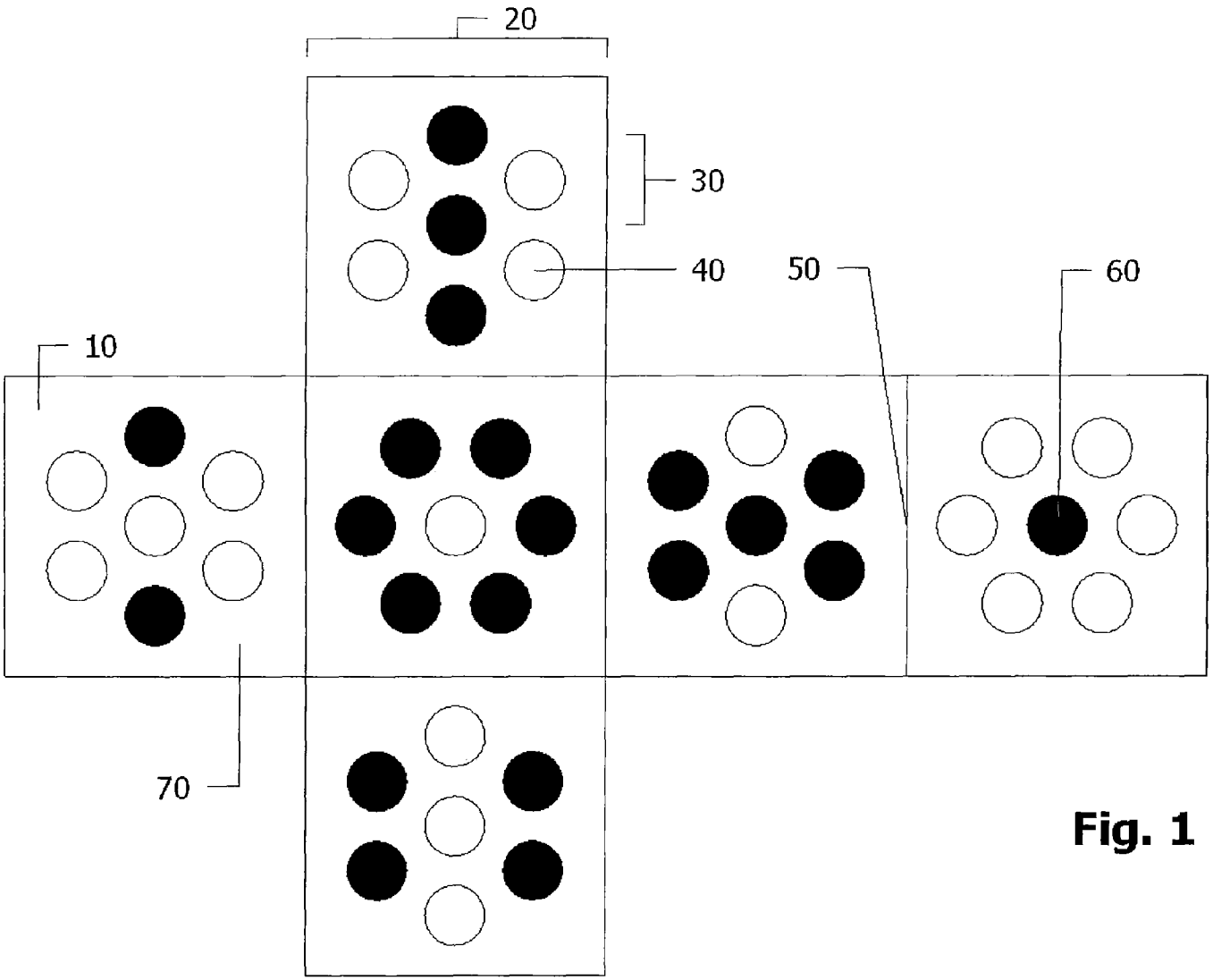
FIG. 1 is a net view of all faces of an embodiment of a die.

As shown in FIG. 1, a cubic die is provided. In some embodiments, the die may be prepared utilizing a CNC milling machine, although various other manners may be used in other embodiments. In this embodiment, the cube is solid, the composition (10) of which may be of hardwood, plastic, glass, rock, or other material, as may be limited by the machine, equipment and/or method of manufacture used.

The length of each edge of the cube (20) of this embodiment is the same, and may be of any size, but is expected to be most desirable in 16 mm (0.625") for most board gaming uses, and 19 mm (0.75") for gambling/casino use. The radius of the hexagon shape (30) represents approximately 30% of the length of each edge of the cube (20). The radius of each indicia (40) represents approximately 10% of the length of each edge of the cube (20).

The die has seven indicia (40) on each face—placed at the vertices of a regular hexagon and one at the center of each face. The hexagon pattern rotates from face to adjacent face, to ensure a physically balanced die. This is demonstrated by the pattern of three indicia at each edge of the cube (50), wherein a vertex of one face is closest to the edge, and two vertices of the adjacent face are closest to the edge.

All indicia are marked with either similar or contrasting color, and preferably in a similar manner, to maintain the physical balance. The contrasting colored "pips" (60) represent the countable indicia from one to six. As with a standard six-sided die, the addition of the pips (60) on one face, and its opposite face, equals seven.

Figure 4:
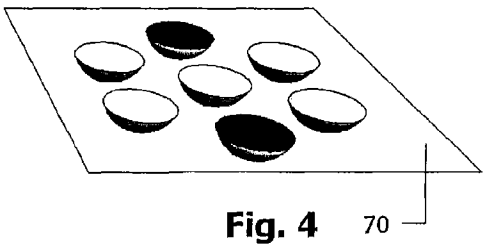
FIG. 4 is a plan view of another representative face of an embodiment of a die.
Figure 3:
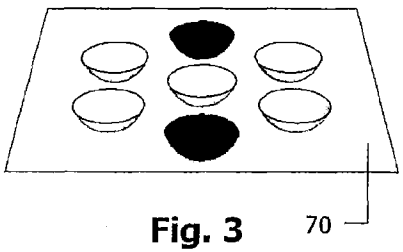
FIG. 3 is a plan view of another representative face of an embodiment of a die.
Figure 2:
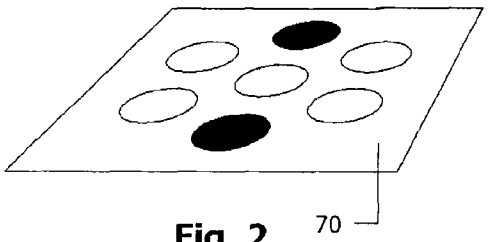
FIG. 2 is a plan view of a representative face of an embodiment of a die.

FIG. 2 is a face of the die (70) wherein the indicia are marked, with paint or otherwise, upon the face of the die. FIG. 3 is a face of the die (70) wherein the indicia are recessed and marked. FIG. 4 is a face of the die (70) wherein the indicia are recessed and filled in with another material of appropriate color, or with material of a neutral color and then marked.

Figure 5:
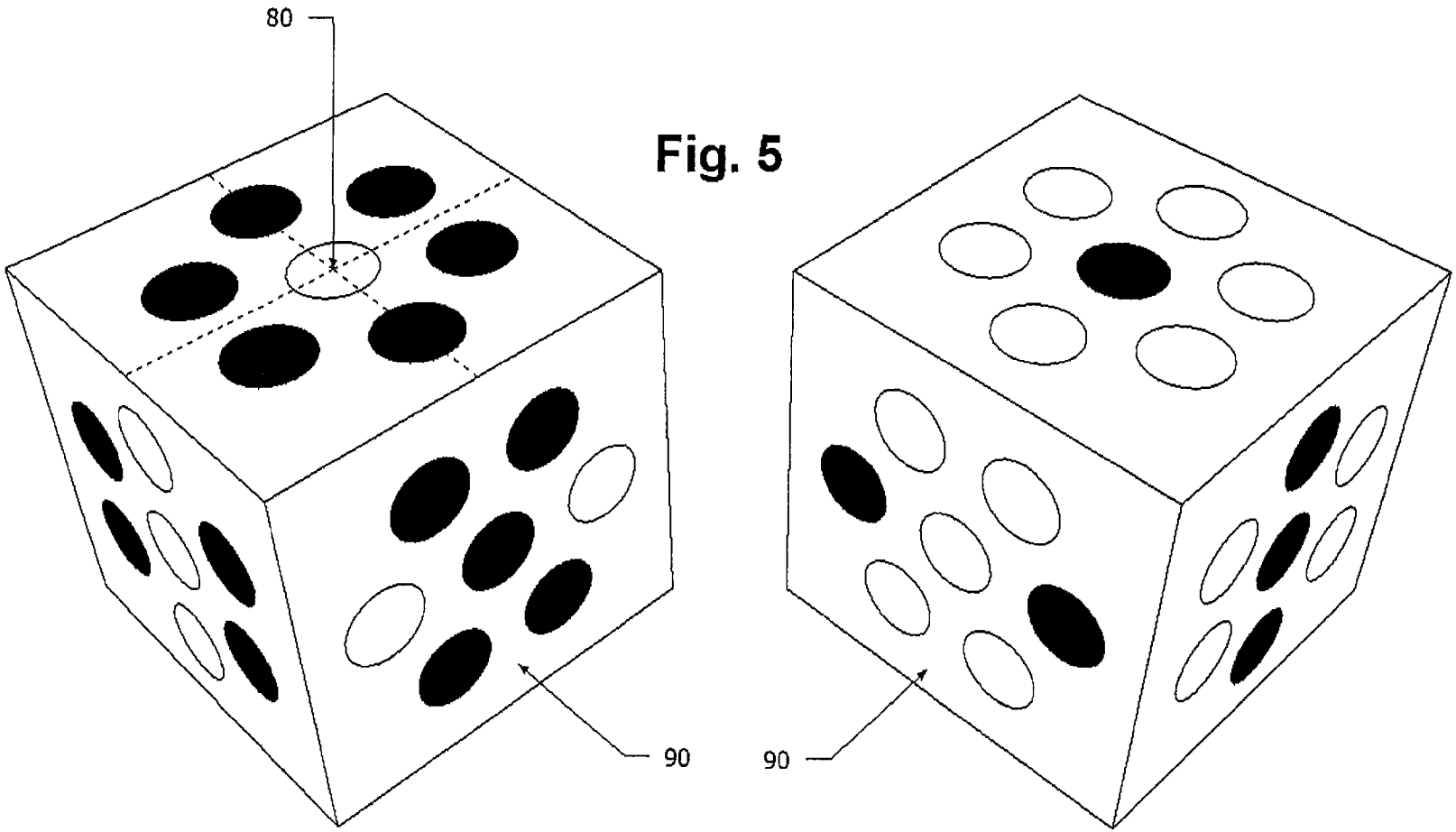
FIG. 5 is a three-dimensional view, from the vertex, of three faces of an embodiment of a die, and from the opposite vertex, a view of the remaining three faces.

FIG. 5 is a three-dimensional view, from the vertex, of three faces of an embodiment of a die, and from the opposite vertex, a view of the remaining three faces. In this embodiment, all pips (60) on each face are vertically and horizontally symmetrical (80), meaning that the horizontal halves of each face are mirror images of each other and the vertical halves of each face are mirror images of each other. Furthermore, the opposite faces are complements, whereby together, the pips (60) occupy all seven indicia (90).

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

I claim:

1. A die comprising:

a cubical body provided with a corresponding set of seven indicia on each face, wherein:

six of the seven indicia of each set form a regular hexagon pattern with a seventh of the indicia being positioned at a center of the corresponding face, the indicia being distinguishable by colors to represent a first subset of the indicia that are to be counted and a second subset of the indicia that are not to be counted;

a first face and a second face of the body have a first edge located therebetween;

the hexagon pattern of the first face is oriented such that a first side of the hexagon pattern of the first face is oriented substantially parallel to the first edge; and the hexagon pattern of the second face is oriented such that a first indicia of the hexagon pattern of the second face is oriented nearest the first edge at a midpoint of the first edge and of the first side of the hexagon pattern of the first face such that the die exhibits symmetric weight distribution with respect to each of four space diagonals, each of the four space diagonals extending from a vertex of the cubical body through a center of the cubical body to an opposing vertex, such that weight distributed along one side of each of the space diagonals from the center of the cubical body is balanced by weight distributed along a corresponding opposing side of each of the space diagonals.

2. The die of claim 1, wherein the indicia are formed by pigment.

3. The die of claim 1, wherein the indicia are formed by recesses.

4. The die of claim 3, wherein the recesses are colored by pigment.

5. The die of claim 3, wherein the recesses are filled by pigmented material.

6. The die of claim 1, wherein the first subset of the indicia that are to be counted exhibit vertical and horizontal symmetry.

7. The die of claim 1, wherein the first subset of the indicia that are to be counted on each face and its opposite face occupy all seven indicia.

* * * * *